US007250007B2

(12) United States Patent
Lu

(10) Patent No.: US 7,250,007 B2
(45) Date of Patent: Jul. 31, 2007

(54) WOOD TYPE GOLF CLUB HEAD

(75) Inventor: Yuan-Ping Lu, Bade (TW)

(73) Assignee: Fu Sheng Industrial Co, Ltd., Taipei (TW)

( * ) Notice: Subject to any disclaimer, the term of this patent is extended or adjusted under 35 U.S.C. 154(b) by 170 days.

(21) Appl. No.: 10/944,813

(22) Filed: Sep. 21, 2004

(65) Prior Publication Data

US 2006/0063609 A1 Mar. 23, 2006

(51) Int. Cl.
*A63B 53/04* (2006.01)

(52) U.S. Cl. ..... 473/329; 473/332; 473/346

(58) Field of Classification Search ..... 473/329, 473/332, 345, 346, 324
See application file for complete search history.

(56) References Cited

U.S. PATENT DOCUMENTS

| | | | | |
|---|---|---|---|---|
| 4,214,754 | A * | 7/1980 | Zebelean | 473/346 |
| 4,438,931 | A * | 3/1984 | Motomiya | 473/346 |
| 4,465,221 | A * | 8/1984 | Schmidt | 228/125 |
| 4,511,145 | A * | 4/1985 | Schmidt | 473/346 |
| 5,351,958 | A * | 10/1994 | Helmstetter | 473/346 |
| 5,649,872 | A * | 7/1997 | Antonious | 473/332 |
| 5,755,627 | A * | 5/1998 | Yamazaki et al. | 473/345 |
| 5,776,011 | A * | 7/1998 | Su et al. | 473/345 |
| 5,911,638 | A * | 6/1999 | Parente et al. | 473/338 |
| 5,921,872 | A * | 7/1999 | Kobayashi | 473/345 |
| 5,997,415 | A * | 12/1999 | Wood | 473/346 |
| 6,001,029 | A * | 12/1999 | Kobayashi | 473/327 |
| 6,089,070 | A * | 7/2000 | Hancock et al. | 72/340 |
| 6,299,548 | B1 * | 10/2001 | Lin | 473/331 |
| 6,368,233 | B1 * | 4/2002 | Chen | 473/342 |
| 6,595,871 | B2 * | 7/2003 | Sano | 473/342 |
| 6,645,087 | B2 * | 11/2003 | Yabu | 473/342 |
| 6,783,465 | B2 * | 8/2004 | Matsunaga | 473/329 |
| 6,849,003 | B2 * | 2/2005 | Kumamoto | 473/305 |
| 6,852,038 | B2 * | 2/2005 | Yabu | 473/224 |
| 6,878,073 | B2 * | 4/2005 | Takeda | 473/346 |
| 6,949,031 | B2 * | 9/2005 | Imamoto et al. | 473/329 |
| 6,969,326 | B2 * | 11/2005 | De Shiell et al. | 473/345 |
| 6,974,393 | B2 * | 12/2005 | Caldwell et al. | 473/324 |
| 7,018,303 | B2 * | 3/2006 | Yamamoto | 473/329 |
| 7,108,614 | B2 * | 9/2006 | Lo | 473/345 |
| 2003/0064823 | A1 | 4/2003 | Yamamoto | |
| 2004/0121853 | A1 * | 6/2004 | Caldwell et al. | 473/345 |
| 2004/0198532 | A1 * | 10/2004 | Caldwell et al. | 473/345 |
| 2004/0224790 | A1 * | 11/2004 | Lu | 473/345 |
| 2005/0075193 | A1 * | 4/2005 | Otoguro | 473/346 |
| 2005/0272526 | A1 * | 12/2005 | Hsu et al. | 473/345 |

FOREIGN PATENT DOCUMENTS

| | | | |
|---|---|---|---|
| FR | 2717702 | A1 * | 9/1995 |
| WO | WO 9320904 | A1 * | 10/1993 |

* cited by examiner

*Primary Examiner*—Sebastiano Passaniti
(74) *Attorney, Agent, or Firm*—Birch, Stewart, Kolasch & Birch, LLP

(57) ABSTRACT

A golf club head includes a striking plate, a golf club head body and a plurality of annular flexible portions. In assembling, the striking plate mechanically connects to a front side of the golf club head body. The golf club head body forms a crown portion, a sole portion, a toe portion, a heel portion and a side portion to constitute a body member. The annular flexible portions are provided on an inner surface of the golf club head body. Thereby, the annular flexible portions can increase an elastic deformation of the golf club head body.

15 Claims, 3 Drawing Sheets

WOOD TYPE GOLF CLUB HEAD

BACKGROUND OF THE INVENTION

1. Field of the Invention

The present invention relates to a wood type golf club head. More particularly, the present invention relates to a golf club head body having a plurality of annular flexible portions in place that increases an elastic deformation of the golf club head body.

2. Description of the Related Art

A conventional wood type golf club head typically includes a golf club head body and a striking plate connected thereto. Generally, the striking plate is made of material with high coefficient of resilience (C.O.R.) and used to strike a golf ball. The golf club head body can be selectively made of metal or nonmetal (such as carbon fiber) and used to return a striking stress to the striking plate. Structurally, the golf club head body includes a crown portion, a sole portion, a toe portion, a heel portion and a side portion to constitute a body member. By such an arrangement, the golf club head can return the striking stress to the striking plate and absorb remained vibrations while striking golf ball.

U.S. patent application Publication No. 2003/0064823 discloses a golf club head. The golf club head commonly includes a golf club head body and a striking plate. In particular, the striking plate includes an inner surface provided with annular-stepped portions that change in thickness for increasing an elastic deformation of the striking plate. As to the golf club head body, it has no corresponding structure for relatively increasing an elastic deformation of the entire golf club head.

However, the golf club head body cannot effectively return the striking stress to the striking plate due to no relative increase of the elastic deformation of the entire golf club head. Additionally, exerting a greater striking stress may cause the golf club head body to permanently deform and crack. In other words, even if the striking plate obtains excellent elasticity, it cannot provide an excellent striking ability with limited elastic deformation of the golf club head body.

Hence, there is a need for a structure of the golf club head body to improve an elastic deformation of the golf club head body for striking a golf ball. To accomplish this task, it is necessary to modify the golf club head body.

The present invention provides a golf club head body having a plurality of annular flexible portions in place that increase an elastic deformation of the golf club head body. Thereby, the annular flexible portions of the golf club head body can increase striking ability, eliminate metal fatigue and intensify strength of the golf club head in such a way to mitigate and overcome the above problem.

SUMMARY OF THE INVENTION

The primary objective of this invention is to provide a wood type golf club head having a golf club head body which forms a plurality of annular flexible portions therein, thereby increasing striking ability, eliminating metal fatigue and intensifying strength of the golf club head.

The secondary objective of this invention is to provide the wood type golf club head having a golf club head body which forms a plurality of annular flexible portions covered with an elastic coating layer, thereby increasingly absorbing vibrations and intensifying strength of the golf club head.

The wood type golf club head in accordance with the present invention includes a striking plate, a golf club head body and a plurality of annular flexible portions. In assembling, the striking plate mechanically connects to a front side of the golf club head body. The golf club head body forms a crown portion, a sole portion, a toe portion, a heel portion and a side portion to constitute a body member. The annular flexible portions are provided on an inner surface of the golf club head body. Thereby, the annular flexible portions can increase an elastic deformation of the golf club head body.

In a separate aspect of the present invention, the annular flexible portions are recessed grooves spaced apart each other.

In a further separate aspect of the present invention, the annular flexible portions are protruded ribs spaced apart each other.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

Figure 1:
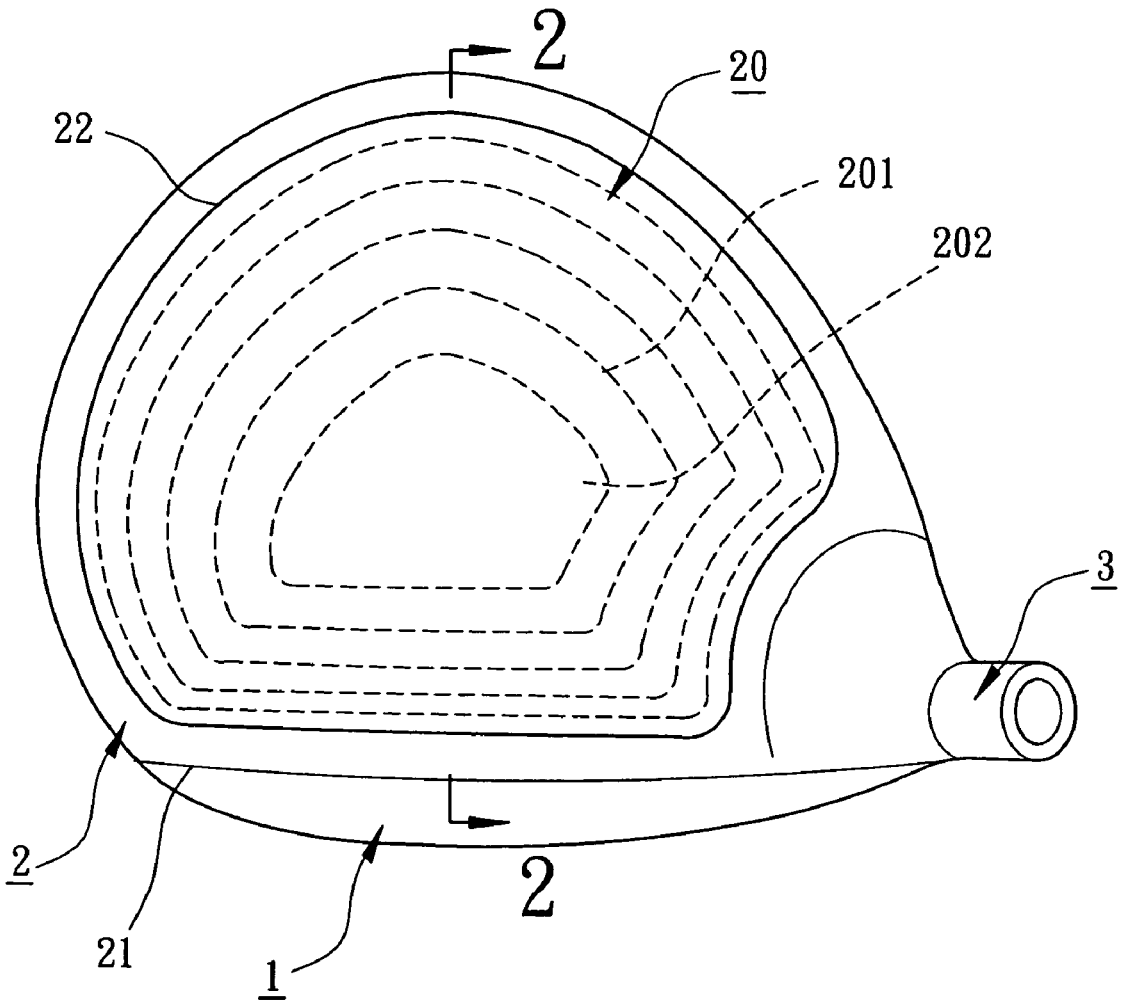
FIG. 1 is a top plan view of a wood type golf club head with a combination of a striking plate with a golf club head body in accordance with a first embodiment of the present invention.
Figure 2:
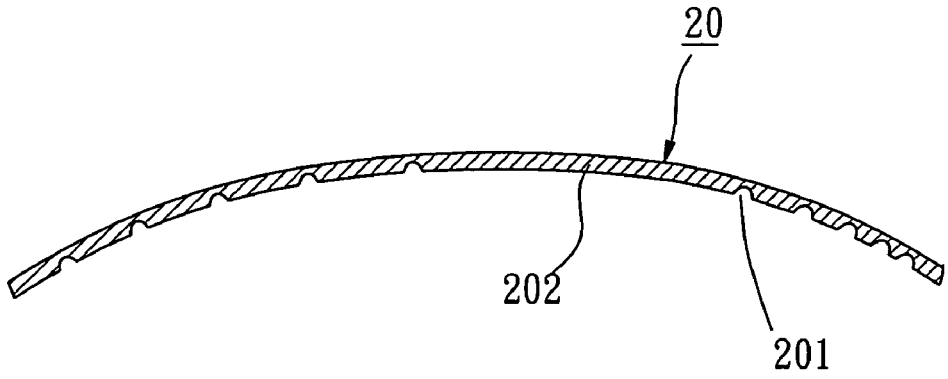
FIG. 2 is a cross-sectional view, taken along line 2—2 in FIG. 1, of a crown plate of the wood type golf club head in accordance with the first embodiment of the present invention.

Referring initially to FIGS. 1 and 2, a wood type golf club head in accordance with a first embodiment of the present invention generally includes a striking plate member designated numeral 1 and a golf club head body member designated numeral 2.

Referring again to FIG. 1, the construction of the wood type golf club head shall be described in detail. The wood type golf club head generally has a basic configuration relatively rigid and strong to withstand normal usage of striking golf ball. The wood type golf club head also generally includes a striking plate 1, a golf club head body 2, a crown plate 20 and a hosel 3, commonly connected to constitute a club head. To increase striking ability, the striking plate 1 and the golf club head body 2 are made of different materials. Furthermore, the golf club head body 2 and the crown plate 20 may also be made of different materials.

Referring again to FIGS. 1 and 2, the construction of the striking plate 1 shall be described in detail. Typically, the striking plate 1 is made of metal or alloy (such as titanium) with high coefficient of resilience (C.O.R.). The striking plate 1 mechanically connects to a front side of the golf club head body 2, and is used to strike a golf ball. Preferably, the striking plate 2 is provided with the same configuration as that of the front side of the golf club head body 2.

Referring again to FIGS. 1 and 2, the construction of the golf club head body 2 and the crown plate 20 shall be described in detail. The golf club head body 2 and the crown plate 20 are made of isotropic material of metal or anisotropic material of nonmetal (such as high polymer or fiber reinforced composite). Structurally, the golf club head body 2 includes a crown portion, a sole portion, a toe portion, a heel portion and a side portion, to constitute a body member. The golf club head body 2 further includes a front assembling hole 21 and a top assembling hole 22 adapted to receive the striking plate 1 and the crown plate 20, respectively. In assembling, the striking plate 1 connects to the front assembling hole 21 of the golf club head body 2 by means of a connection means. The crown plate 20 correspondingly connects to the top assembling hole 22 of the golf club head body 2 by means of a connection means. As has been described, the connection means is selected from a group consisting of welding, press fitting, adhering, braze welding, casting and screw connecting.

Referring again to FIGS. 1 and 2, the crown plate 20 forms a crown portion of the golf club head body 2. The crown plate 20 has an identical thickness and is relatively rigid and strong to withstand normal usage of striking a golf ball. The crown plate 20 has an inner surface consisting of a plurality of annular flexible portions 201 and a buffer portion 202, as best shown in FIG. 2. Each of the annular flexible portions 201 is coaxially expanded and spread from a center portion of the crown plate 20, as best shown by dotted lines at 201 in FIG. 1. Each of the annular flexible portions 201 is a closed loop of a recessed groove. Preferably, each of the annular flexible portions 201 is provided with the same configuration as that of an outer periphery of the crown plate 20. Namely, each of the annular flexible portions 201 is provided with the same configuration as that of an inner periphery of the top assembling hole 22 of the golf club head body 2. The buffer portion 202 is used to constitute a buffer zone for attenuating elastic deformation of the crown plate 20.

Referring again to FIG. 1, the construction of the hosel 3 shall be described in detail. The hosel 3 is located at a side of the golf club head body 2, and adapted to connect to a shaft (not shown) by means of a connection means. As has been described, the connection means is selected from a group consisting of welding, press fitting, adhering, braze welding, casting and screw connecting.

Figure 3:
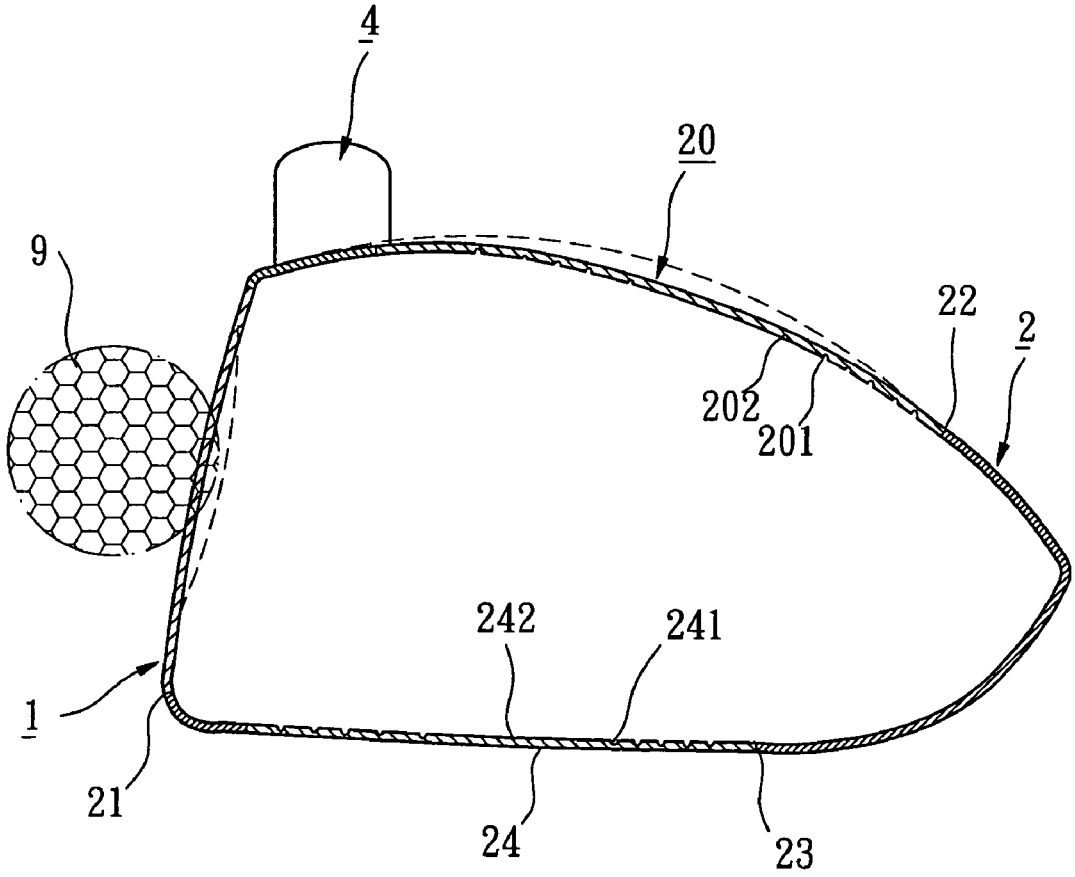
FIG. 3 is a cross-sectional view of the wood type golf club head in accordance with the first embodiment of the present invention while striking golf ball.

Turning now to FIG. 3, the striking operation of the striking plate 1 and the golf club head body 2 shall be described in detail. The striking plate 1, the golf club head body 2, the crown plate 20 and the hosel 3 are commonly connected to constitute a club head after assembling. In addition to real lines, as best shown by dotted lines in FIG. 3, the striking plate 1 is impacted by a golf ball 5 and thus elastically deformed toward a rear side of the golf club head body 2 while striking a golf ball. Subsequently, a striking stress is transmitted to the golf club head body 2 and the crown plate 20. In particular, a greater stress force is exerted on the crown plate 20. Since the crown plate 20 is provided with the annular flexible portions 201 and the buffer portion 202, the annular flexible portions 201 and the buffer portion 202 may change a section modulus of the crown plate 20. Therefore, the crown plate 20 performs at a relatively higher coefficient of resilience to permit a greater elastic deformation which may increase endurance for metal fatigue. Preferably, it is an advantage of having the closed loop of the recessed groove in the present invention that the striking stress may be uniformly dispersed for increasing uniform deformation ability. Due to the annular flexible portions 201 and the buffer portion 202, the crown plate 20 can perform a greater elastic deformation which permits the striking stress to return from the crown plate 20 to the striking plate 1. Consequently, the striking plate 1 can adequately employ the striking stress to improve the striking ability of the wood type golf club head. As the elastic deformation is increased, the possibility of permanently deforming or cracking the crown plate 20 is reduced.

Referring again to FIG. 3, the golf club head body 2 further includes a bottom assembling hole 23 and a sole plate 24 connected thereto. The sole plate 24 is selectively made of metal or nonmetal. Preferably, an inner surface of the sole plate 24 includes a plurality of annular flexible portions 241 and a buffer portion 242 for increasing elastic deformation. Desirably, the annular flexible portions 201 and the buffer portion 202 can be selectively located at an inner surface of one of the toe portion, the heel portion and the side portion of the golf club head body 2 for increasing elastic deformation.

Figure 4:
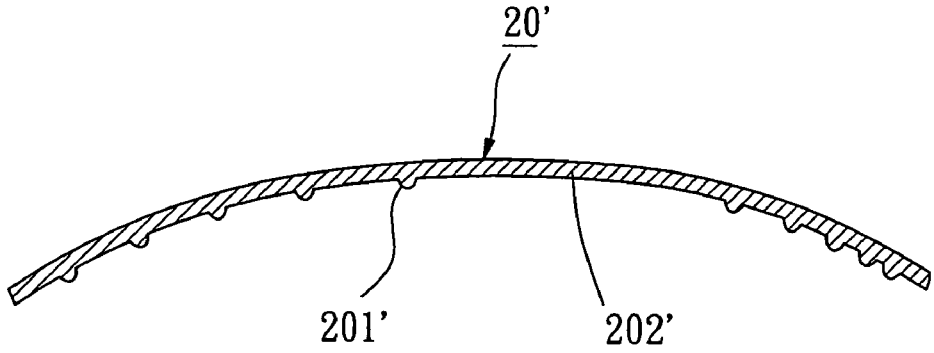
FIG. 4 is a cross-sectional view, similar to that in FIG. 2, of the crown plate of the wood type golf club head in accordance with a second embodiment of the present invention.

Turning now to FIG. 4, reference numerals of the second embodiment of the present invention have applied the identical numerals of the first embodiment, as shown in FIG. 1. The construction of the golf club head structure in accordance with the second embodiment of the present invention has similar configuration and same function as that of the golf club head structure of the first embodiment and detailed descriptions may be omitted.

Referring again to FIG. 4, in comparison with the first embodiment, the crown plate 20' of the second embodiment has an inner surface consisting of a plurality of annular flexible portions 201' and a buffer portion 202'. Each of the annular flexible portions 201' is coaxially expanded and spread from a center portion of the crown plate 20. Each of the annular flexible portions 201' is a closed loop of a protruded rib. Preferably, each of the annular flexible portions 201' is provided with the same configuration as that of an outer periphery of the crown plate 20'. Thereby, the annular flexible portions 201' of the crown plate 20' are able to increase elastic deformation.

In a design choice, the annular flexible portions 201 of the recessed grooves and the annular flexible portions 201' of the protruded ribs are alternatively arranged on a crown plate to provide various degrees of elastic deformation.

Figure 5:
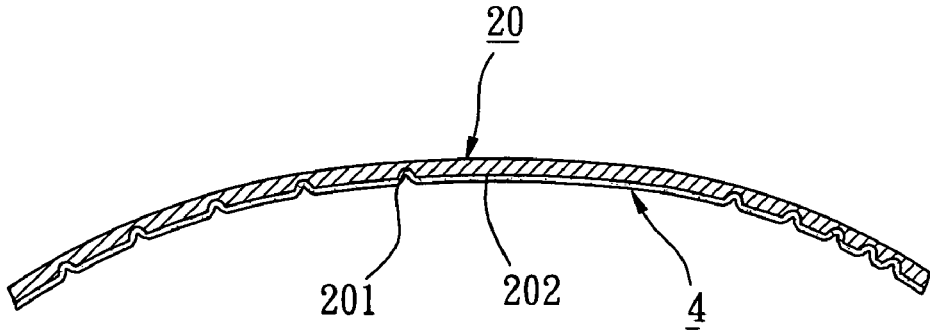
FIG. 5 is a cross-sectional view, similar to that in FIG. 2, of the crown plate of the wood type golf club head in accordance with a third embodiment of the present invention.

Turning now to FIG. 5, reference numerals of the third embodiment of the present invention have applied the identical numerals of the first embodiment, as shown in FIG. 1. The construction of the golf club head structure in accordance with the third embodiment of the present invention has similar configuration and same function as that of the golf club head structure of the first embodiment and detailed descriptions may be omitted.

Referring again to FIG. 5, in comparison with the first embodiment, the crown plate 20 of the third embodiment has an inner surface covered with elastic coating layer 4. As best shown in FIG. 3, the elastic coating layer 4 may not obstruct the top assembling hole 22 of the golf club head body 2 while assembling. The elastic coating layer 4 is made of PU material or the like that covers the annular flexible portions 201 and the buffer portion 202. Preferably, the elastic coating layer 4 has a thickness relatively thin enough to permit deformation of the crown plate 20. In use, the elastic coating layer 4 reinforces the crown plate 20 and the annular flexible portions 201 for increasing strength thereof. Therefore, the thickness of the crown plate 20 may further be reduced. Meanwhile, the elastic coating layer 4 can absorb vibrations of the golf club head body 2 that may improve a striking feel for comfort.

Figure 6:
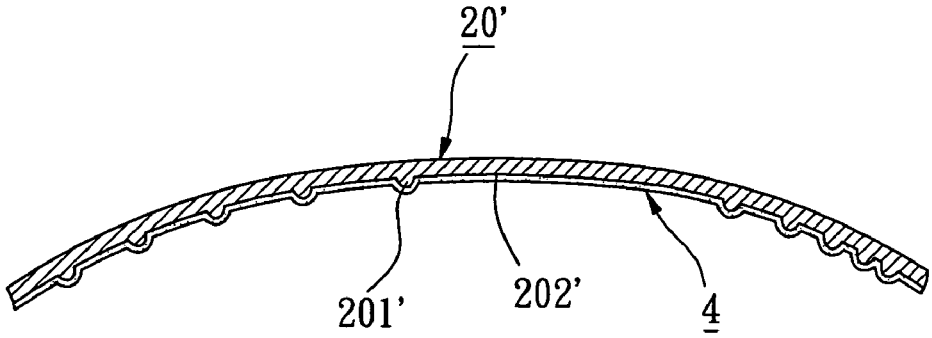
FIG. 6 is a cross-sectional view, similar to that in FIG. 2, of the crown plate of the wood type golf club head in accordance with a fourth embodiment of the present invention.

Turning now to FIG. 6, reference numerals of the fourth embodiment of the present invention have applied the identical numerals of the second embodiment, as shown in FIG. 4. The construction of the golf club head structure in accordance with the fourth embodiment of the present invention has similar configuration and same function as that of the golf club head structure of the second embodiment and detailed descriptions may be omitted.

Referring again to FIG. 6, in comparison with the second embodiment, the crown plate 20' of the fourth embodiment has an inner surface covered with elastic coating layer 4. The elastic coating layer 4 is made of PU material or the like that covers the annular flexible portions 201' and the buffer portion 202'. Preferably, the elastic coating layer 4 has a thickness relatively thin enough to permit deformation of the crown plate 20'. In use, the elastic coating layer 4 reinforces the crown plate 20' and the annular flexible portions 201' for increasing strength thereof. Meanwhile, the elastic coating layer 4 can absorb striking vibrations of the golf club head body 2 that may thus improve a striking feel of hands for comfort.

As has been described, the conventional wood type golf club head has no means to improve deformation of the golf club head body. Accordingly, it is a disadvantage of the conventional golf club head body applied to various elastic deformations of the striking plate that the golf club head body may be cracked while striking golf ball. Referring back to FIG. 1, the golf club head body 2 of the present invention employs the crown plate 20 with the annular flexible portions 201 that may increase striking ability, eliminate metal fatigue and intensify strength of the golf club head. In addition, the golf club head body 2 of the present invention employs the crown plate 20 with the elastic coating layer 4 that may further absorb striking vibrations of the golf club head.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A wood type golf club head comprising:

a golf club head body including a crown portion, a sole portion, a toe portion, a heel portion and a side portion to constitute a body member;

a striking plate adapted to connect to a front side of the golf club head body; and a plurality of annular flexible portions provided on an inner surface of one of the crown portion, the sole portion, the toe portion, the heel portion, and the side portion of the golf club head body, said annular flexible portions being selected from a series of ring portions;

wherein said annular flexible portions enhance elastic deformation of the golf club head body while striking golf ball.

2. The wood type golf club head as defined in claim 1, wherein the golf club head body further includes a top assembling hole adapted to receive a crown plate, and the crown plate includes an inner surface on which said annular flexible portions are provided.

3. The wood type golf club head as defined in claim 2, wherein each of said annular flexible portions of the crown plate is coaxially expanded and spread from a center portion of the crown plate.

4. The wood type golf club head as defined in claim 3, wherein each of said annular flexible portions of the crown plate is provided with same configuration as that of an outer periphery of the crown plate.

5. The wood type golf club head as defined in claim 2, wherein the inner surface of the crown plate further includes a buffer portion used to constitute a buffer zone for attenuating elastic deformation of the crown plate.

6. The wood type golf club head as defined in claim 1, wherein the golf club head body further includes a bottom assembling hole and a sole plate connected thereto, and the sole plate includes an inner surface on which said annular flexible portions are provided.

7. The wood type golf club head as defined in claim 6, wherein each of said annular flexible portions of the sole plate is coaxially expanded and spread from a center portion of the sole plate.

8. The wood type golf club head as defined in claim 7, wherein each of said annular flexible portions of the sole plate is provided with the same configuration as that of an outer periphery of the sole plate.

9. The wood type golf club head as defined in claim 6, wherein the inner surface of the sole plate further includes a buffer portion used to constitute a buffer zone for attenuating elastic deformation of the sole plate.

10. The wood type golf club head as defined in claim 1, wherein each of said annular flexible portions is a closed loop of a recessed groove.

11. The wood type golf club head as defined in claim 1, wherein each of said annular flexible portions is a closed loop of a protruded rib.

12. The wood type golf club head as defined in claim 1, wherein said annular flexible portions consist of recessed grooves and protruded ribs, and said recessed grooves and protruded ribs are alternatively arranged.

13. The wood type golf club head as defined in claim 1, further comprising an elastic coating layer covering said annular flexible portions provided on the inner surface of the golf club head body.

14. The wood type golf club head as defined in claim 1, wherein no annular flexible portion is provided on an inner surface of the striking plate.

15. The wood type golf club head as defined in claim 1, wherein said ring portions are concentric.

* * * * *